US006270821B1

(12) United States Patent
Grip et al.

(10) Patent No.: US 6,270,821 B1
(45) Date of Patent: Aug. 7, 2001

(54) MULTIPURPOSE MARKETING POUCH

(75) Inventors: Michael G. Grip, Midvale; Paul F. Reed, Sandy, both of UT (US)

(73) Assignee: Norbest, Inc., Midvale, UT (US)

( * ) Notice: Subject to any disclaimer, the term of this patent is extended or adjusted under 35 U.S.C. 154(b) by 0 days.

(21) Appl. No.: 09/405,430

(22) Filed: Sep. 23, 1999

Related U.S. Application Data

(60) Provisional application No. 60/101,894, filed on Sep. 25, 1998.

(51) Int. Cl.[7] ..... B65B 55/00

(52) U.S. Cl. ..... 426/394; 426/383; 426/410; 426/413; 426/418; 383/40

(58) Field of Search ..... 426/106, 110, 426/112, 123, 132, 122, 383, 410, 413, 394, 418; 383/40, 22, 11, 37, 38, 117, 71, 102

(56) References Cited

U.S. PATENT DOCUMENTS 2,669,047 * 2/1954 Rieger ..... 40/637
3,540,184 * 11/1970 Ashton ..... 53/415
3,632,995 * 1/1972 Wilson ..... 235/494
3,762,628 * 10/1973 Sargent ..... 383/40
3,994,089 * 11/1976 Schwartz ..... 40/310
4,071,063 * 1/1978 Russell ..... 150/12
4,194,680 * 3/1980 Scott et al. ..... 229/43
4,492,306 * 1/1985 Cooper et al. ..... 206/216
4,635,291 * 1/1987 Barton ..... 383/24
5,169,198 * 12/1992 Volk et al. ..... 294/137
5,213,371 * 5/1993 Bradley ..... 283/56
5,300,344 * 4/1994 Niedecker ..... 428/131
5,576,037 * 11/1996 Moore, Jr. et al. ..... 426/110

* cited by examiner

*Primary Examiner*—Nina Bhat
(74) *Attorney, Agent, or Firm*—Madson & Metcalf

(57) ABSTRACT

A marketing pouch is provided having an interior pocket region surrounded by a sealed peripheral edge and having an attachment member extending from the marketing pouch. Examples of possible attachment members include an integral portion of the pouch itself, adhesive tape bonded to the pouch, and string-like material affixed to the pouch. The pocket region contains marketing material, such as a roasting bag, coupons, recipes, and/or spice mixes. The attachment member has a sufficient length to facilitate attachment of the marketing pouch to meat or poultry package clips.

18 Claims, 12 Drawing Sheets

MULTIPURPOSE MARKETING POUCH

This application claims benefit under 35 USC 189 (e) of Prov. application 60/101,894, filed Sep. 25, 1998.

FIELD OF THE INVENTION

The present invention relates to a multipurpose marketing pouch for use in connection with the retail sale of meat and poultry. The pouch is configured to contain a cooking or roasting bag for the meat product, advertising or promotional materials, spices, seasonings, recipes, or other similar items.

BACKGROUND

Roasting Bags. The innovation of the cooking bag was a boon to the meat and poultry industry. Use of a cooking bag when roasting, for example, a whole turkey in the oven, provides significant benefits to the consumer or to an institutional chef. The cooking bag reduced the time it took to cook the turkey. The bag allowed the natural juices from the turkey to be kept for later use such as making a natural turkey gravy. Also, the cooking bag, by containing both the turkey and the juices, made clean-up much easier for the cook.

For many years processors and marketers of poultry products, such as turkey and chicken, have tried to sell a roasting bag with the poultry product itself. None of the efforts have been particularly successful.

One effort attempted to place the cooking bag inside the body cavity of the poultry. This had several drawbacks. Consumers did not know what the bag was, and often threw it away with the giblets. The bag was often covered with blood and other fluids, and could transmit naturally occurring pathogens to the kitchen counter when the bag was removed. This resulted in the potential cross-contamination of other foods.

Another effort was to make a roasting bag the bag in which the meat or poultry product was packaged. Unfortunately, consumers who were used to removing the bag before cooking the product did so before they realized they had destroyed the roasting bag. The cooking bag was undesirable for cooks who like to stuff the birds with their own stuffing. And, on occasion, the bags would be perforated during handling or shipping. This also reduced their benefits.

Another attempt was to double-bag the products, with the inner bag being a roasting bag. This was also unsatisfactory because of the difficulty in removing the outer bag without also cutting the inner bag. The double bag also prevented the stuffing of poultry.

A final attempt was to place a bag containing a roasting bag outside the bag in which the product was packaged, but underneath the netting which was placed around the product. Although this idea eliminated the problems described above, it came with its own set of difficulties. During the netting and heat shrinking process, the bag would sometimes slip away from its intended location on the product. The bag would sometimes wrinkle, making the printed information difficult to read. This packaging process was problematic and expensive, and it could not be used for products without netting.

Despite the foregoing problems, because of the popularity and convenience of roasting bags, there is a continued need for an effective and convenient method of providing a roasting bag with the retail sales of meat and poultry products.

Marketing Materials. Many manufacturers have tried to attach marketing materials to products, but attaching such materials to a frozen or refrigerated product with no flat surface has been difficult. Coupons or recipes which are enclosed in or printed directly on the packaging material are often destroyed when the packaging is removed from the product for cooking. Handling the materials can also lead to cross-contamination of other foods if not immediately sanitized.

At least one manufacturer has placed a bag containing a string turkey lifter outside the packaging bag, but underneath netting placed around the turkey product. As mentioned above, this packaging process was problematic and expensive, and it could not be used for products without netting.

There are other problems as well. It is distasteful for consumers to handle materials which are covered with blood or other natural juices from the products. Such materials are often missed by consumers because of a lack of visibility. They are often wrinkled and difficult to read.

From the foregoing, it would be a substantial advancement in the art to have an effective and convenient method of providing marketing and promotional materials with the retail sales of meat and poultry products.

SUMMARY OF THE INVENTION

The present invention is directed to a multipurpose marketing pouch configured to contain marketing material, such as roasting bags, coupons, advertizing or promotional materials, recipes, preparation or use instructions, and spice mixes. The pouch is constructed of a polymeric material which can be printed, opaque, or clear plastic. Preferably it is constructed of a clear plastic sheet. The pouch contains an interior pocket region surrounded by a sealed peripheral edge. The pocket region is sized and configured to contain the marketing material. The peripheral edge is preferably sealed with a fluid tight seal to protect the marketing material from external contamination. There are a variety of different methods of manufacturing a pouch or bag having a fluid tight seal. For instance, the fluid tight seal can be provided by polymeric material folded at one peripheral edge and bonded together at its other edges, by tubular polymeric material bonded at its ends, by separate polymeric sheets bonded together, or by use of a prefabricated polymeric bag.

In some currently preferred embodiments, an attachment mechanism facilitates attachment of the marketing pouch to a meat or poultry package. Several possible attachment mechanisms can be used within the scope of the present invention. For a non-netted product, the marketing pouch is preferably attached to the packaging clip by use of an attachment member which extends from a portion of the peripheral edge of the pouch. The attachment member must be long enough to allow it to be clipped under the packaging clip. The attachment member preferably has a length greater than one inch, and preferably in the range from one to three inches. A shorter attachment member might be usable in some applications. Longer attachment members can be used, but typically a longer attachment member contains wasted material.

For product which is netted, the pouch can be attached to the product under the netting clip in the same manner described above with the packaging clip. Alternatively, the pouch can be attached to the netting loop or handle.

It is possible to affix the pouch directly to the surface of the meat or poultry packaging by adhesive tape or glue. This embodiment is best used with products having a generally flat surface.

One embodiment of the marketing pouch can be made by obtaining a first layer of polymeric sheet material and placing marketing material on the first layer. The marketing material is then overlaid with a second layer of polymeric sheet material. The second layer of polymeric sheet material can be a separate sheet of material or it can be a portion of the first sheet material that is folded over the marketing material.

The layers of polymeric sheet material are sealed together around the marketing material to form an interior pocket region surrounded by a sealed peripheral edge. A portion of the sealed peripheral edge is enlarged, and excess material is removed to form a stem that extends from the peripheral edge a sufficient distance to permit attachment to the packing or netting clip. This stem attachment member preferably extends at least one inch from the interior pocket region, and preferably from one to three inches. The stem can be used to affix the marketing pouch to a meat or poultry package according to conventional attachment techniques. In addition, weight and price information and product logos can be optionally applied to an exterior surface of the marketing pouch.

DESCRIPTION OF THE INVENTION

The present invention is directed to a multipurpose marketing pouch for use in connection with the retail sale of meat and poultry. The pouch is sized and configured to contain a cooking or roasting bag for the meat or poultry product. Advertising or promotional materials, spices, seasonings, recipes, or other similar items can also be included in the pouch.

Figure 1:
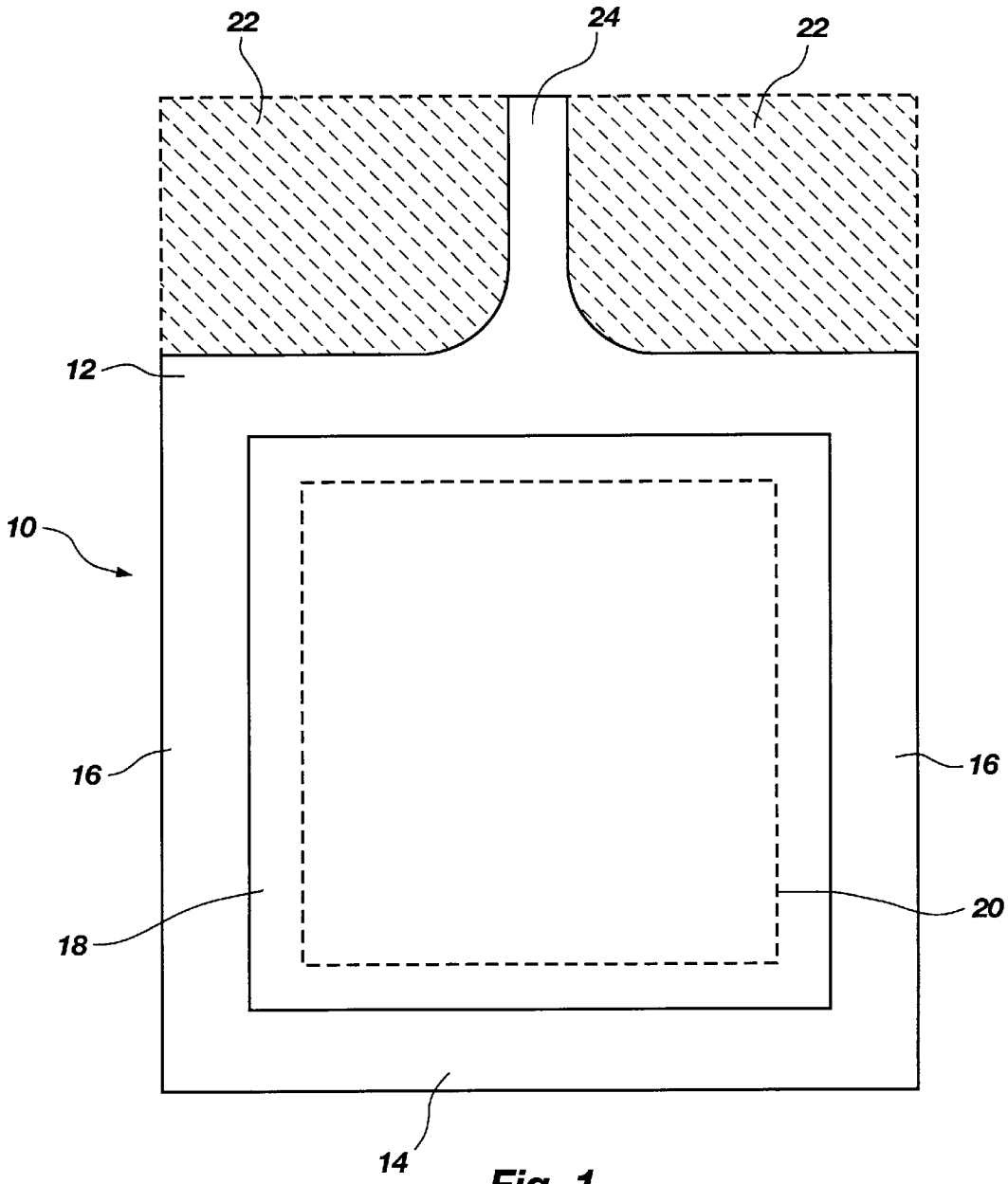
FIG. 1 is a top view of a multipurpose marketing pouch within the scope of the present invention.

One currently preferred configuration of the pouch is illustrated in FIG. 1. The pouch 10 is prepared from polymeric sheet materials which are sealed at a top end 12, a bottom end 14, and sides 16. The sealed peripheral edge surrounds an interior pocket region 18 configured to contain marketing material 20. Marketing material 20 to be held within pouch 10 is placed within the pouch before its sides and ends are sealed. Examples of typical marketing material include a roasting bag, coupons, promotional materials, recipes, instructions and/or seasonings.

In the embodiment illustrated in FIG. 1, the sealed material 22 adjacent at the top end 12, shown in dashed lines, extends into the pouch 10 a distance of about two inches, and preferably in the range from about one to three inches. A portion of this sealed material is removed to form a long, attachment member or stem 24. Depending upon the strength of the material used to prepare the stem 24, it may be reinforced to provide sufficient strength to securely hold the pouch to the meat or poultry packaging under normal processing, shipping, and use.

Figure 2:
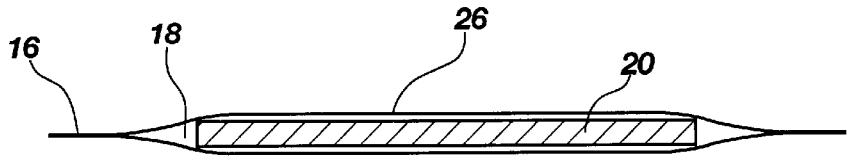
FIG. 2 is a cross-sectional view of the multipurpose marketing pouch of FIG. 1.

With the stem 24, the pouch 10 can replace the weight tag which is currently used with many poultry and meat products. The weight and price information can be applied on the pouch surface 26, shown in FIG. 2, or on a pressure-sensitive label applied to the pouch surface 26. The pouch 10 is preferably applied to the meat or poultry product at the same time of the net or bag clipping process and in the same manner as the current weight tag, so there are no additional labor costs.

Figure 3:
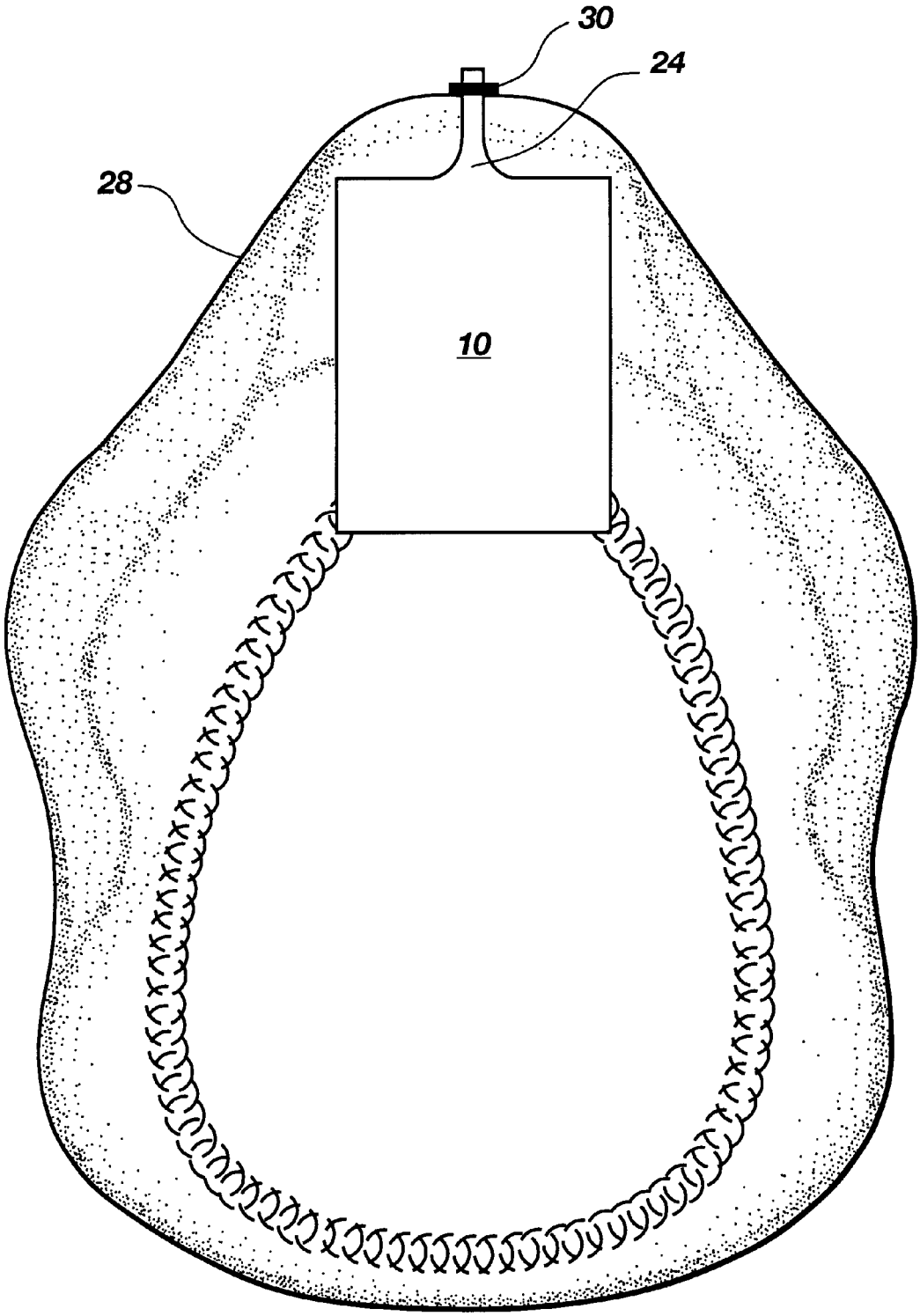
FIG. 3 is a view of a multipurpose marketing pouch in which the attachment member is a stem affixed to the packaging clip of a turkey product.
Figure 4:
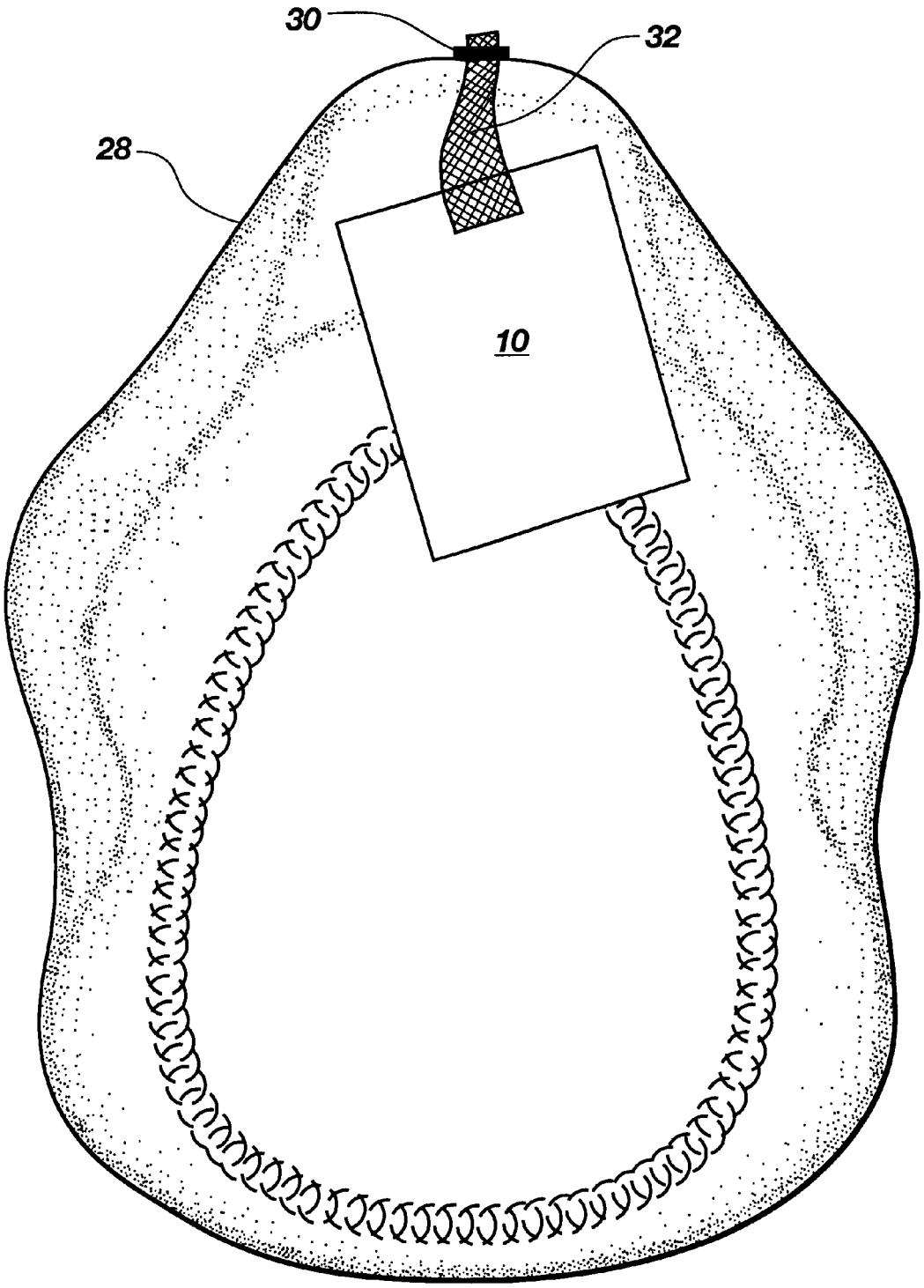
FIG. 4 is a view of a multipurpose marketing pouch in which the attachment member is strong adhesive tape material affixed to the packaging clip of a turkey product.
Figure 5:
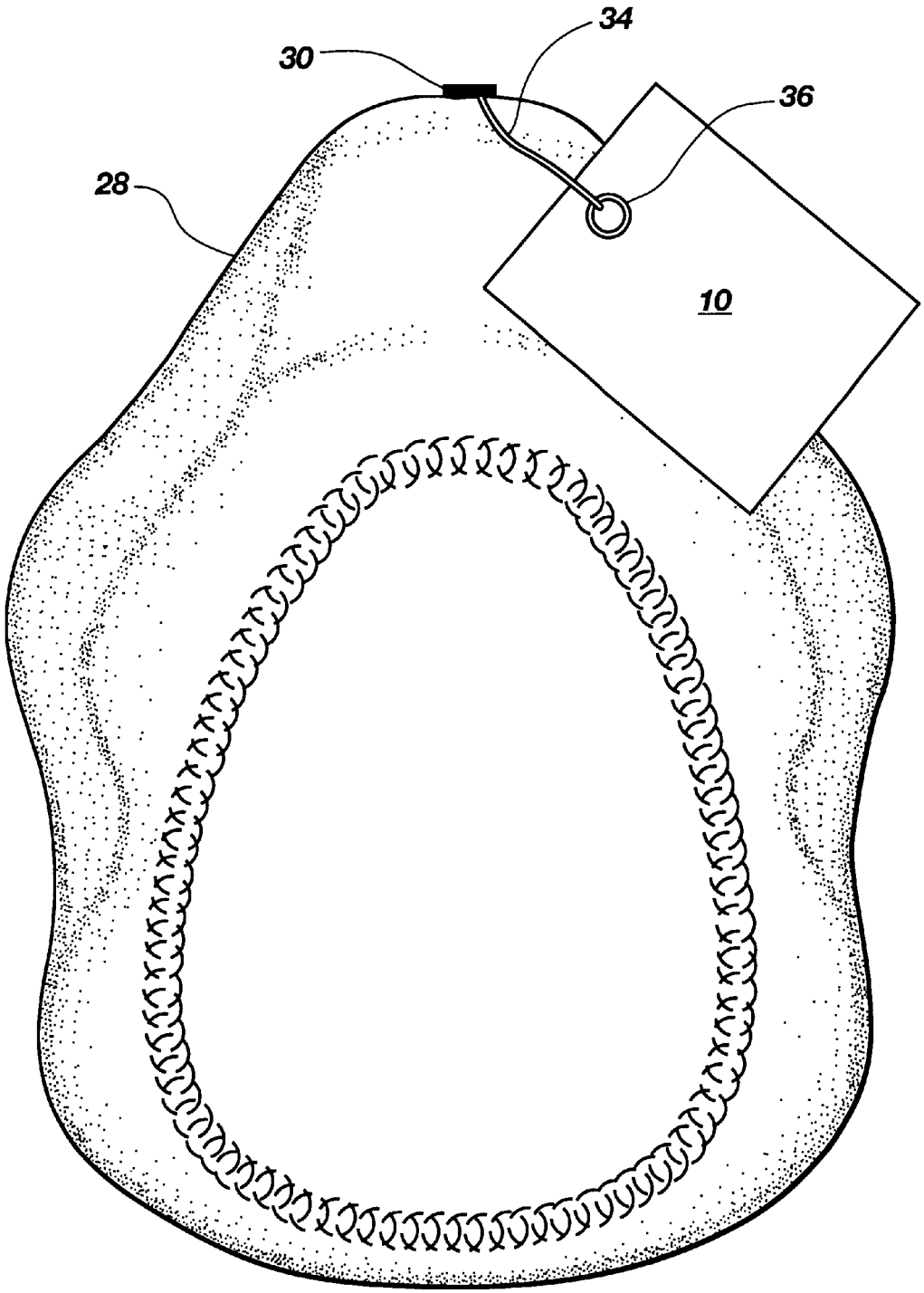
FIG. 5 is a view of a multipurpose marketing pouch in which the attachment member is a string or cord material, secured to the pouch with a grommet, affixed to the packaging clip of a turkey product.

For example, using the neck or stem 24, the pouch 10 can be attached to a poultry product 28 under the packaging clip 30 as shown in FIG. 3. In FIG. 3, a stem 24 represents the attachment member attached to the packaging clip 30. Other possible attachment members are illustrated in FIGS. 4 and 5. In FIG. 4, strong adhesive tape material 32 represents the attachment member attached to the packaging clip 30. The tape material 32 is preferably securely bonded to the pouch. In one embodiment, both ends of a length of tape 32 are bonded to the pouch, with the remaining center portion of the tape bonded to itself to form a attachment member. In FIG. 5, a string-like material 34, attached to the pouch with a grommet 36 represents the attachment member affixed to the packaging clip. The string-like material is preferably a string or cord material with sufficient strength to securely hold the pouch to the packaging clip 30 under normal processing, shipping, and use.

Figure 8:
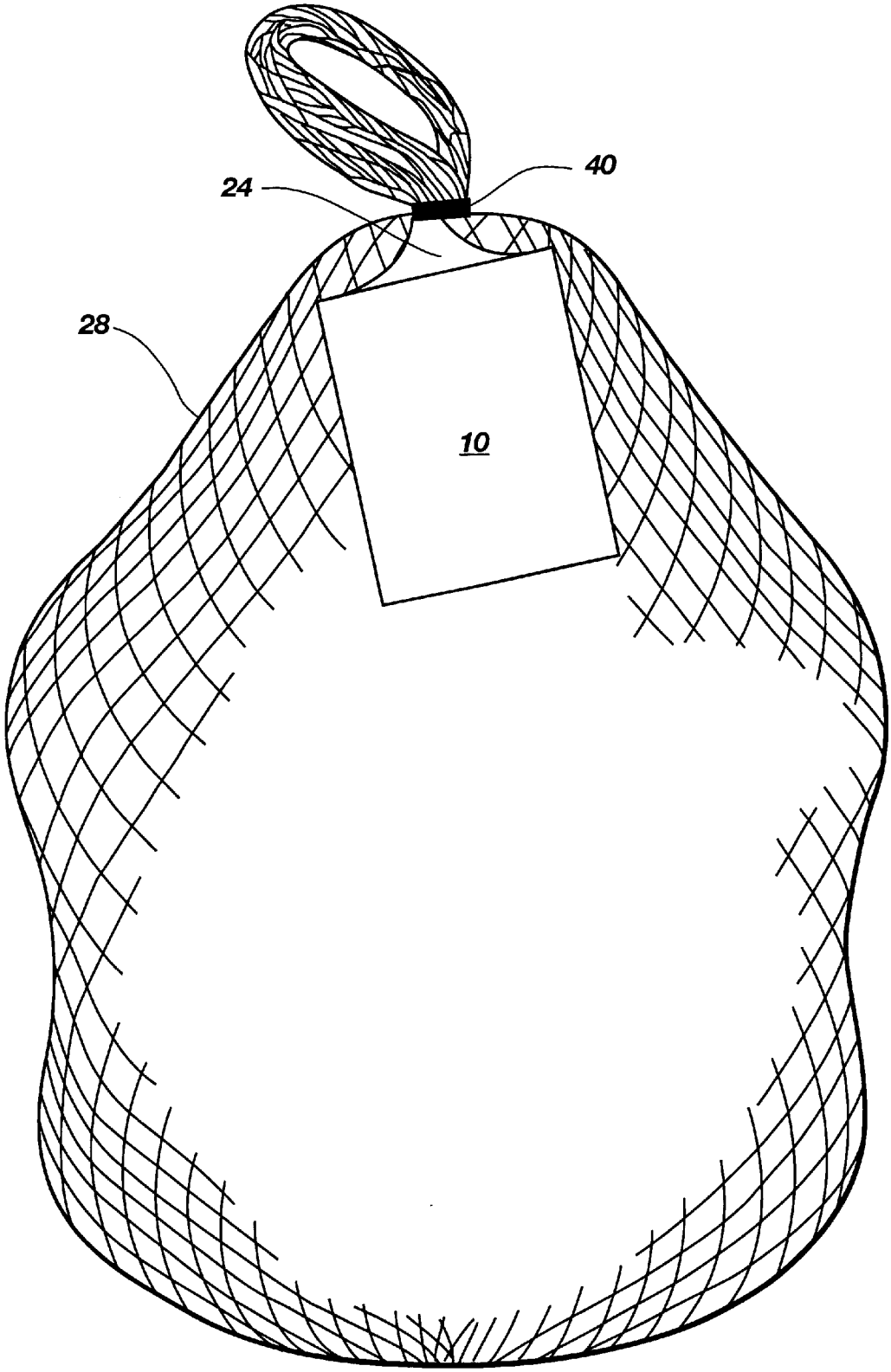
FIG. 8 is a view of a multipurpose marketing pouch in which the attachment member is a stem affixed to the netting clip of a netted turkey product.
Figure 9:
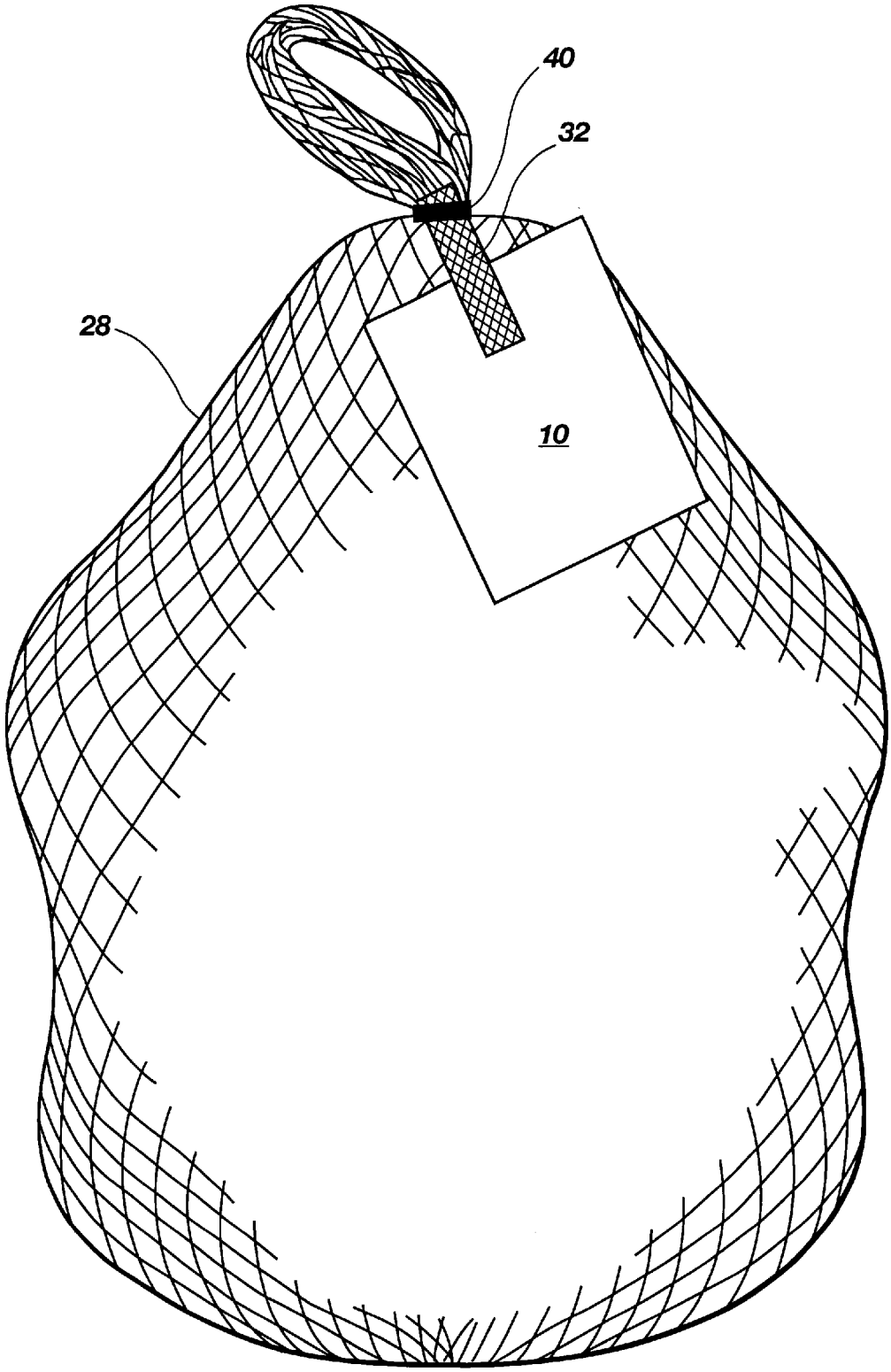
FIG. 9 is a view of a multipurpose marketing pouch in which the attachment member is strong adhesive tape material affixed to the netting clip of a netted turkey product.
Figure 10:
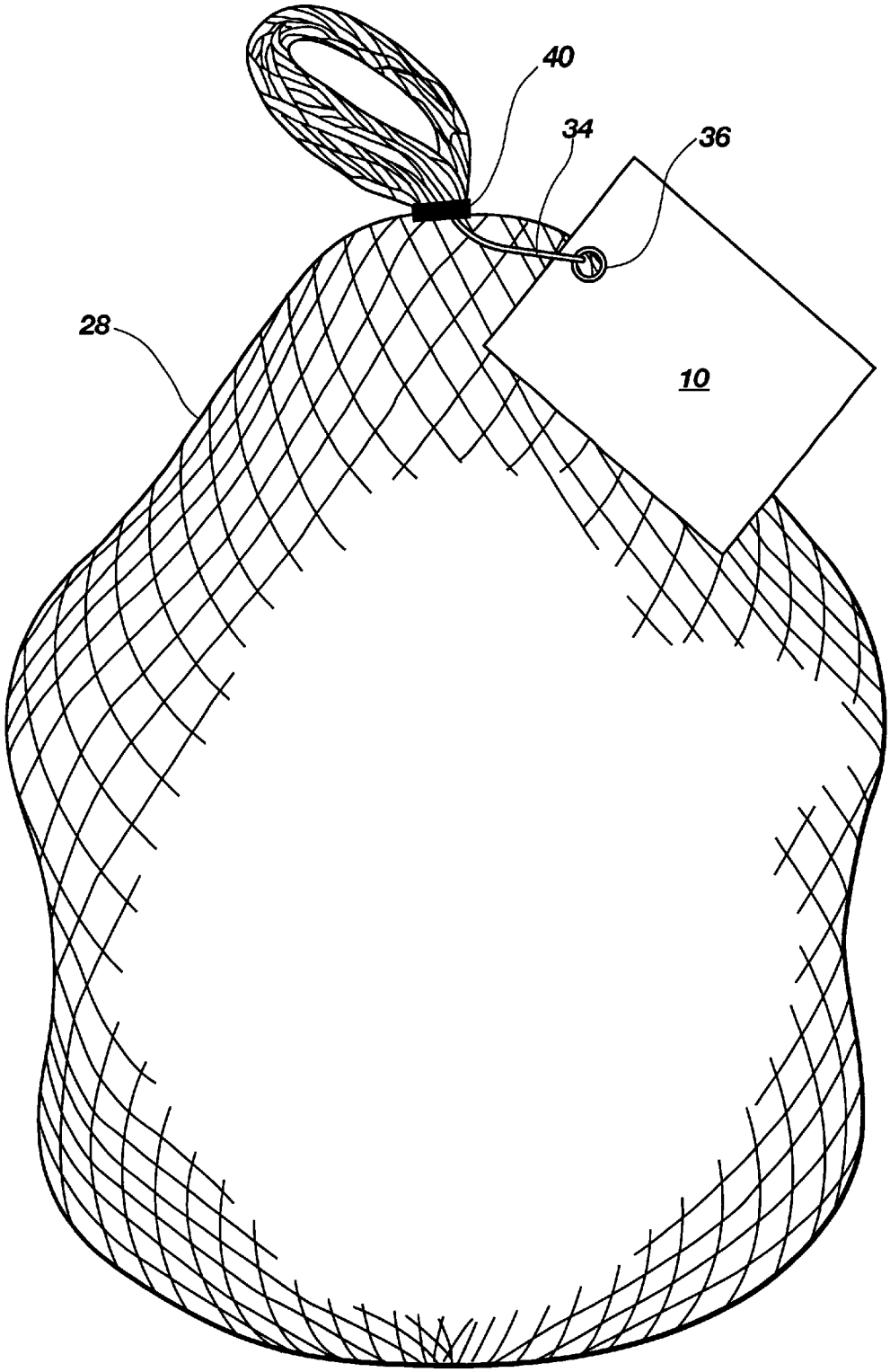
FIG. 10 is a view of a multipurpose marketing pouch in which the attachment member is a string or cord material, secured to the pouch with a grommet, affixed to the netting clip of a netted turkey product.

For product which is netted, the pouch can be affixed to poultry product 28 under the netting clip 40 as shown in FIGS. 8–10 in substantially the same manner it is attached under the packaging clip shown in FIGS. 3–5. In FIG. 8, a stem 24 represents the attachment member attached to the netting clip 40. In FIG. 9, tape material 32 forms the attachment member attached to the netting clip 40. In FIG. 10, a string-like material 34, attached to the pouch with a grommet 36 represents the attachment member affixed to the netting clip 40.

Figure 11:
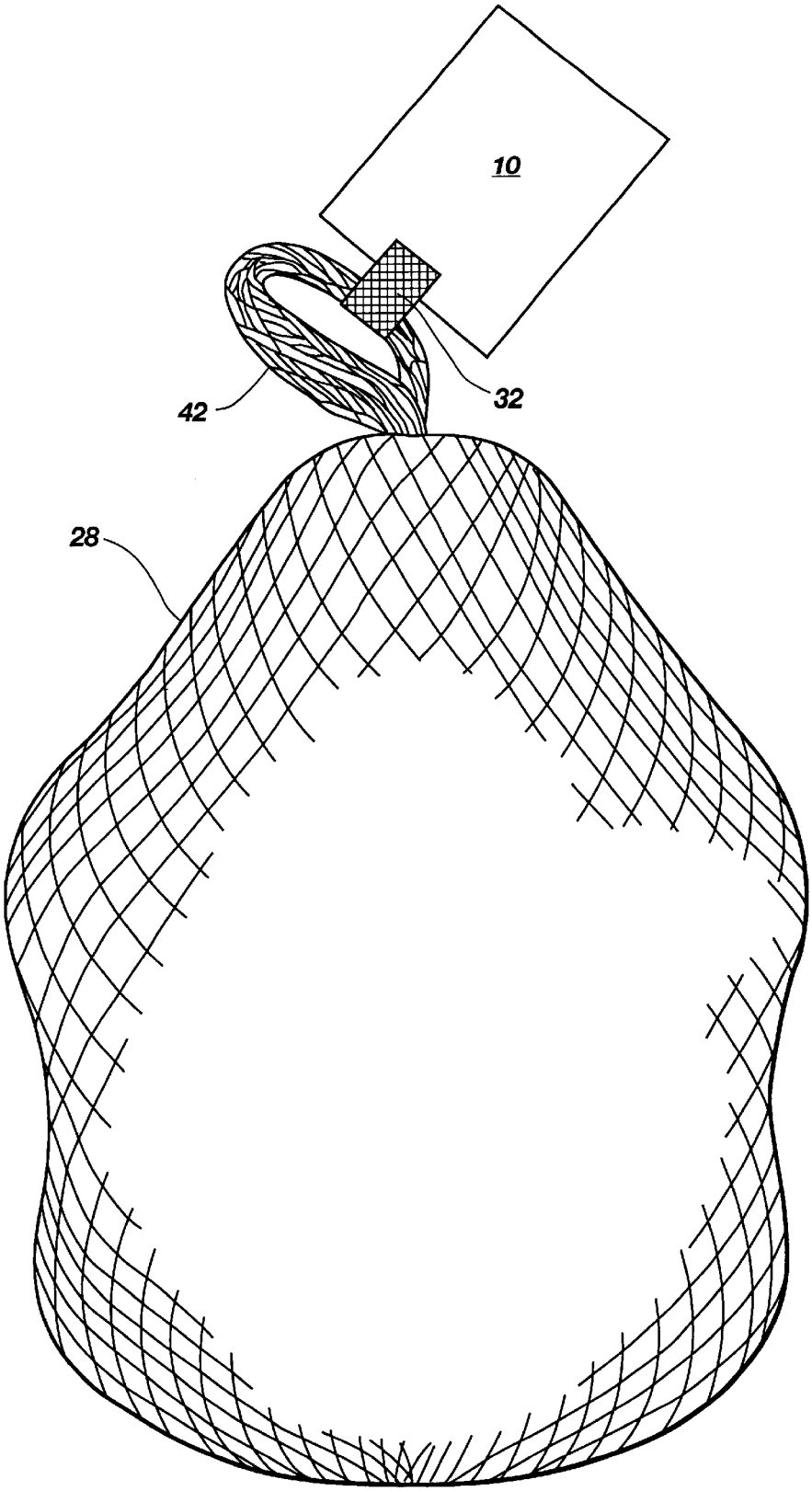
FIG. 11 is a view of a multipurpose marketing pouch attached to a netting loop of a netted turkey product, in which the attachment member is strong adhesive tape affixed to the pouch and wrapped around the netting loop.
Figure 12:
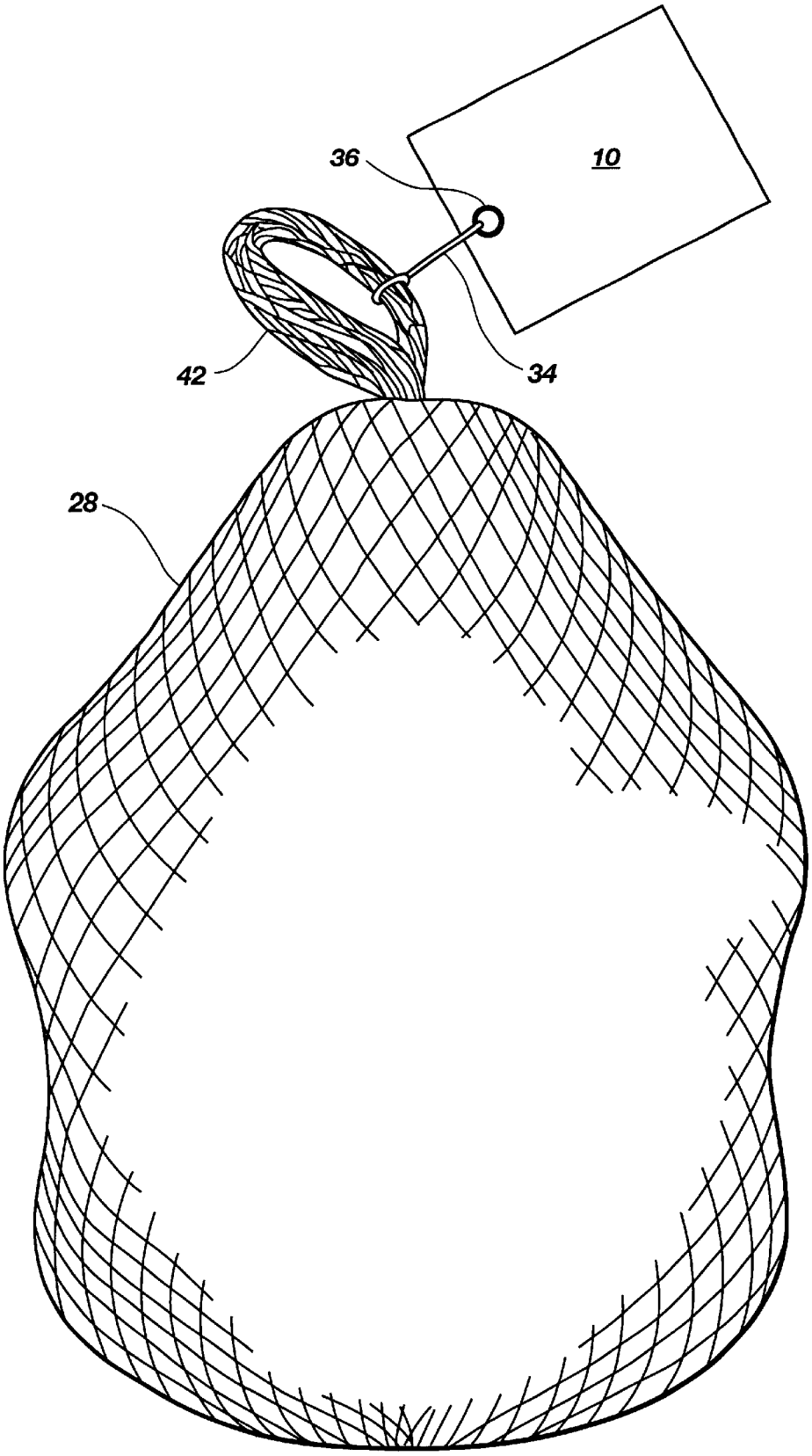
FIG. 12 is a view of a multipurpose marketing pouch attached to a netting loop of a netted turkey product, in which the attachment member is a string or cord material, secured to the pouch with a grommet, affixed to the pouch and wrapped around the netting loop.
Figure 13:
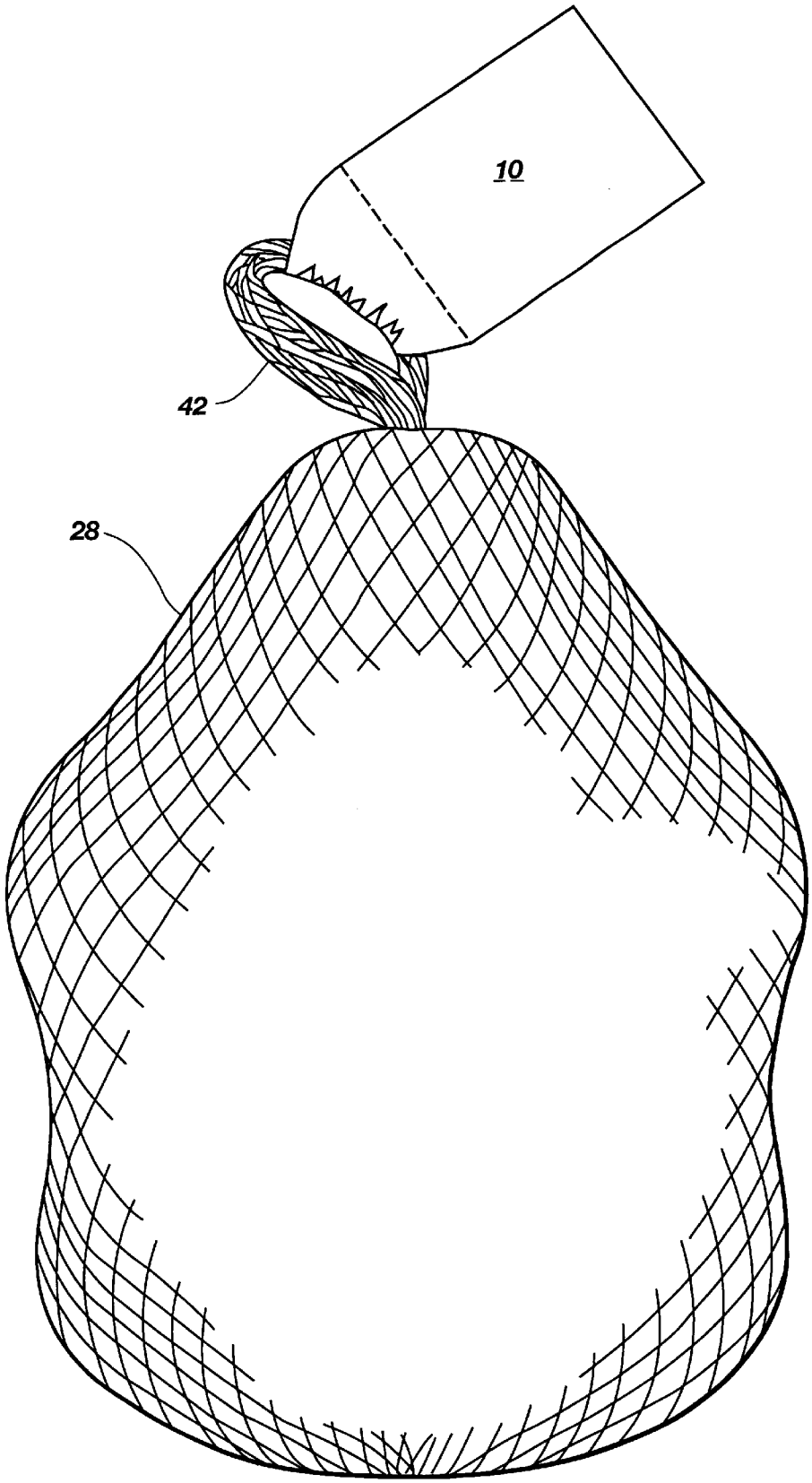
FIG. 13 is a view of a multipurpose marketing pouch attached to a netting loop of a netted turkey product, in which the attachment member is a portion of the pouch material wrapped around the netting loop.

The pouch 10 can also be attached to the poultry product 28 at the netting loop 42 shown in FIGS. 11–13. In FIG. 11, the illustrated attachment member is strong adhesive tape material 32 affixed to the pouch 10 and looped around the netting loop 42. In FIG. 12, the illustrated attachment member is a string-like material 34 around the netting loop 42 and attached to the pouch using a grommet 36. In FIG. 13, the attachment member is a portion 44 of the pouch itself which is looped around the netting loop 42.

Figure 6:
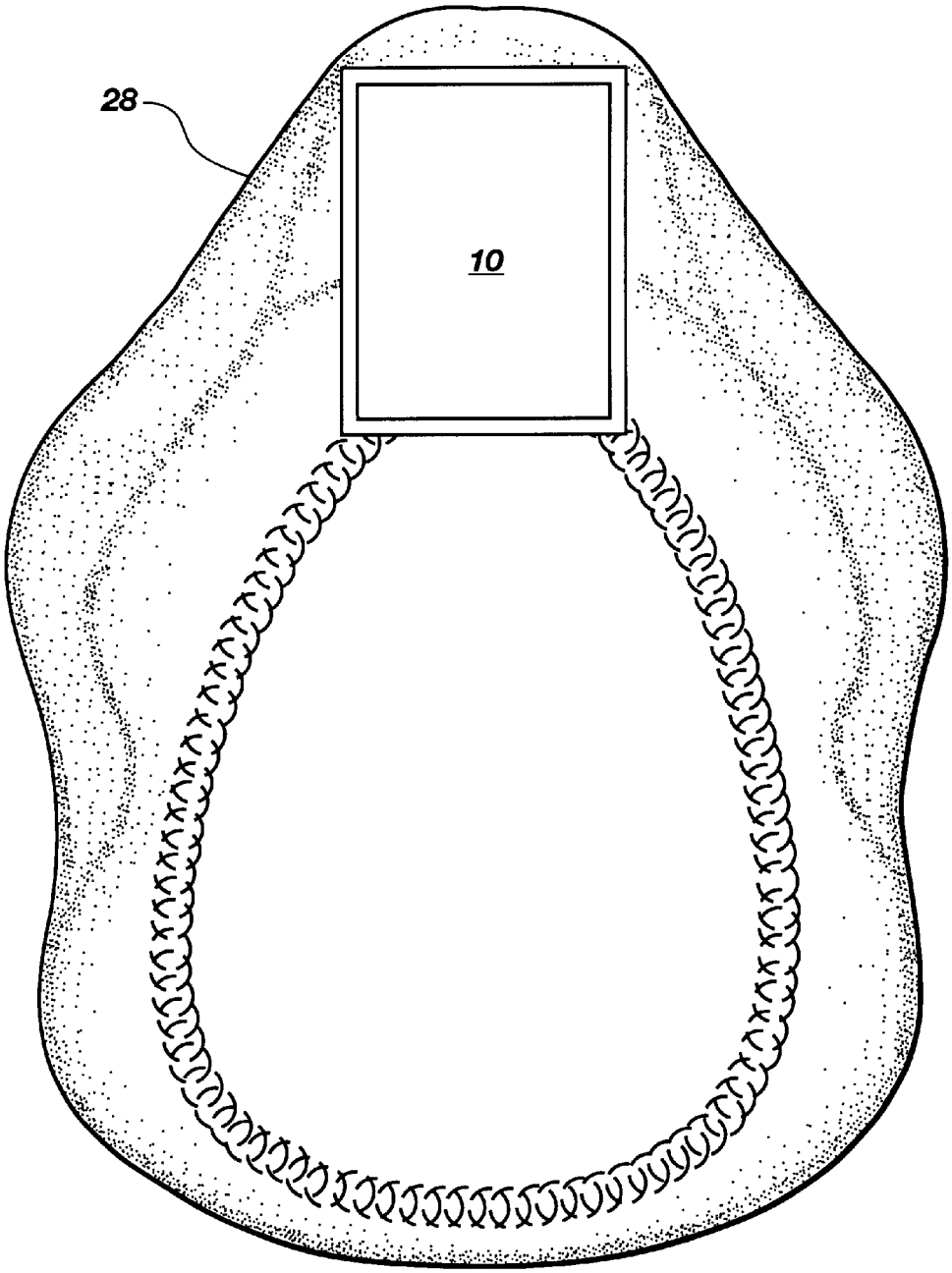
FIG. 6 is a view of a multipurpose marketing pouch directly affixed to the turkey product.
Figure 7:
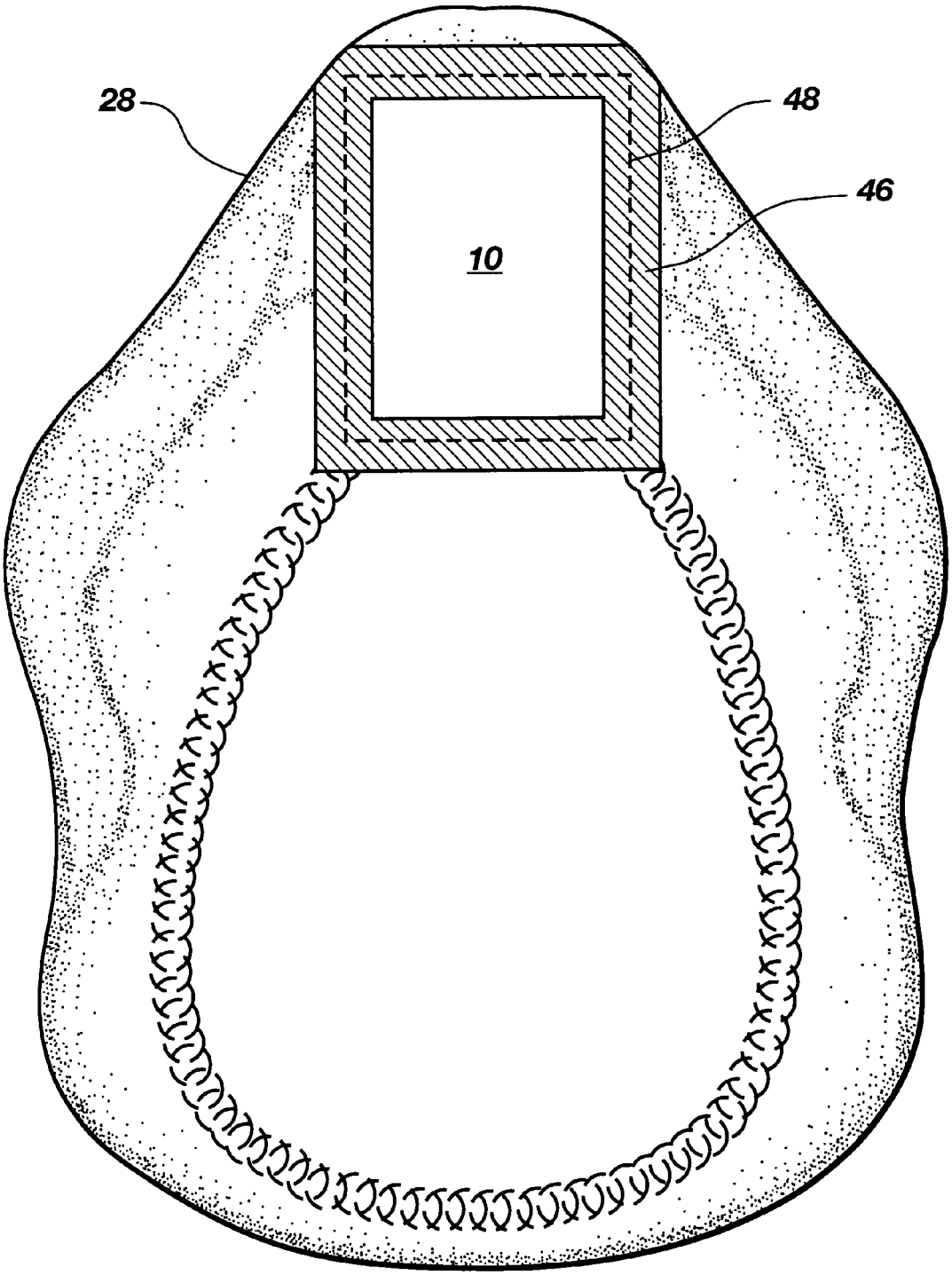
FIG. 7 is a view of a multipurpose marketing pouch directly affixed to the turkey product by adhesive tape.

In another embodiment, the pouch 10 can be attached directly to the meat or poultry package surface. As shown in FIG. 6, the pouch 10 can be attached to a non-netted poultry product 28 by gluing it to the product exterior surface. FIG. 7 shows the pouch taped to the package surface with adhesive tape 46. Although the embodiment illustrated in FIG. 7 shows narrow adhesive tape 46 around the peripheral edge 48, shown in dashed lines, of the pouch 10, it is within the skill in the art to use large width adhesive tape that covers the pouch 10 and extends beyond the peripheral edge 48 of the pouch 10.

Although the present invention is illustrated in use with a poultry product, it will be appreciated by those having skill in the art that the present invention can be used with meat products that are packaged in a manner similar to conventional poultry products.

At least three new and useful applications of the pouch 10 are disclosed below:

Using an externally placed pouch for marketing materials. The pouch 10 can be used for many types of marketing materials, and is preferable to printing on the meat or poultry bag and preferable to placing stickers on bags. It eliminates possible cross-contamination of the foods when it is removed from the product. The pouch 10 is a visible marketing tool and eliminates the wrinkling of marketing materials which is sometimes seen today with current applications.

Putting a roasting bag separate from but with the product. Many companies have tried to enclose roasting bags inside meat or poultry packages, but no one has attached it to the exterior of the package so that it is separate from the product itself but still attached to it.

A roasting bag, when used with the proposed pouch, can be taken from the meat or poultry package without damaging or removing either the bag or the packaging from the product itself. The separate roasting bag eliminates the cross-contamination, visibility and accidental destruction problems of other means of presenting the roasting bags to consumers.

This is also a convenience to the consumer, who does not have to purchase or store a roasting bag separately because it comes with the product with which it is intended to be used. The pouch also eliminates the frustration of some consumers who have difficulty finding roasting bags in the grocery store. The bag is already attached to the product they desire to cook in the bag.

Attaching the pouch to the product. Using a pouch for marketing materials and attaching it to the meat or poultry product package is a novel idea. Several means for attachment are within the scope of the present invention, including using an attachment member to attach the pouch under the netting clip or under the packaging clip (if there is no netting), attaching the pouch to the netting loop or handle, attaching the pouch with a heat seal, and attaching the pouch directly to the product surface by glue or adhesive tape. It allows marketing materials such as roasting bags, coupons, advertizing or promotional materials, recipes, preparation or use instructions, and spice mixes to be sold or attached to the products without the cross-contamination concerns associated with other ways which have been tried before. This helps the consumer to have safer food in his or her home.

Packaging concerns such as slipping or wrinkling during the heat-shrinking process are eliminated. The pouch will be consistently located in the same place on the product. The consumer will readily recognize that the pouch is separate from the product and will not likely discard it by accident.

Advantages of the Multipurpose Pouch

1. Eliminates potential food safety hazards caused by cross-contamination of other foods, preparation surfaces and the cook's hands when removing cooking bags or other marketing materials from meats and poultry.

2. Eliminates waste caused by accidental nicking or destruction or accidental discarding of cooking bags already placed on meat or poultry products.

3. Easier for consumers to see marketing materials. The product is attached to the meat or poultry in a way that the consumers are already accustomed to seeing.

4. Eliminates wrinkling, folding, moving of marketing materials or roasting bags attached using current technology 5. Cheaper for consumers. The current cost of cooking bags is 75¢ to $1.00 per bag. Attaching a cooking bag in the pouch will cost the consumer less than 35¢ per bag. This is a significant cost savings and convenience.

6. One-stop shopping for consumers. Instead of trying to find cooking bags in the grocery store, the bag is attached directly to the product which is to be roasted inside the bag.

7. There is little added labor cost to the process because the pouch replaces the weight tag which is in current use in the industry.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A method of attaching a marketing pouch to a meat or poultry package comprising the steps of:

obtaining a marketing pouch, constructed of polymeric material, defining an interior pocket region surrounded by a fluid tight sealed peripheral edge, wherein said pocket region contains marketing material, wherein said marketing pouch has an attachment member extending from the marketing pouch to facilitate attachment of the marketing pouch to a meat or poultry package; and affixing the marketing pouch to the meat or poultry package.

2. A method according to claim 1, wherein the marketing pouch is affixed to the meat or poultry package by positioning the attachment member under a netting or packaging clip.

3. A method according to claim 2, wherein the marketing attachment member has a length in the range from 1 to 3 inches long.

4. A method according to claim 2, wherein the attachment member comprises a string material secured to the pouch.

5. A method according to claim 1, wherein the marketing pouch is affixed to the meat or poultry package by looping the attachment member through a netting loop or handle.

6. A method according to claim 5, wherein the marketing attachment member has a length in the range from 1 to 3 inches long.

7. A method according to claim 5, wherein the attachment member comprises a string material secured to the pouch.

8. A method according to claim 1, further comprising the step of applying weight and price information to an exterior surface of the marketing pouch.

9. A method according to claim 1, wherein the marketing material is selected from coupons, advertising or promotional materials, recipes, preparation or use instructions, and spice mixes.

10. A method according to claim 1, wherein the marketing pouch is affixed to a turkey package by positioning the attachment member under a netting or packaging clip, and wherein the marketing material includes a roasting bag.

11. A method according to claim 1, wherein the marketing pouch is constructed of clear, printed or opaque polymeric material.

12. A method of attaching a marketing pouch to a meat or poultry package comprising the steps of:

obtaining a marketing pouch, constructed of polymeric material, defining an interior pocket region surrounded by a fluid tight sealed peripheral edge, wherein said pocket region contains a roasting bag, wherein said marketing pouch has an attachment member extending from the marketing pouch to facilitate attachment of the marketing pouch to a meat or poultry package; and affixing the marketing pouch to the meat or poultry package.

13. A method according to claim 12, wherein the marketing pouch is affixed to the meat or poultry package by positioning the attachment member under a netting or packaging clip.

14. A method according to claim 12, wherein the marketing pouch is affixed to the meat or poultry package by looping the attachment member through a netting loop or handle.

15. A method according to claim 12, further comprising the step of applying weight and price information to an exterior surface of the marketing pouch.

16. A method according to claim 12, wherein the marketing pouch further contains marketing material selected from recipes, preparation or use instructions, and spice mixes.

17. A method according to claim 12, wherein the marketing pouch is constructed of clear, printed or opaque polymeric material.

18. A method according to claim 12, wherein the marketing attachment member has a length in the range from 1 to 3 inches long.

* * * * *